US011927202B2

(12) United States Patent
Chen et al.

(10) Patent No.: US 11,927,202 B2
(45) Date of Patent: Mar. 12, 2024

(54) SERVER FAN GUARD

(71) Applicant: Quanta Computer Inc., Taoyuan (TW)

(72) Inventors: Chao-Jung Chen, Taoyuan (TW); Yu-Nien Huang, Taoyuan (TW); Herman Tan, Taoyuan (TW)

(73) Assignee: QUANTA COMPUTER INC., Taoyuan (TW)

( * ) Notice: Subject to any disclaimer, the term of this patent is extended or adjusted under 35 U.S.C. 154(b) by 230 days.

(21) Appl. No.: 16/947,526

(22) Filed: Aug. 5, 2020

(65) Prior Publication Data

US 2021/0324878 A1 Oct. 21, 2021

Related U.S. Application Data

(60) Provisional application No. 63/013,363, filed on Apr. 21, 2020.

(51) Int. Cl.

| | |
|---|---|
| ***F04D 29/70*** | (2006.01) |
| ***F04D 19/00*** | (2006.01) |
| ***F04D 29/32*** | (2006.01) |
| ***F04D 29/52*** | (2006.01) |

(52) U.S. Cl.

CPC ..... *F04D 29/703* (2013.01); *F04D 19/002* (2013.01); *F04D 29/325* (2013.01); *F04D 29/522* (2013.01)

(58) Field of Classification Search

CPC ..... F04D 29/325; F04D 29/52; F04D 29/522; F04D 29/70; F04D 29/701; F04D 29/703; F04D 19/002

USPC ..... 416/247 R

See application file for complete search history.

(56) References Cited

U.S. PATENT DOCUMENTS

| | | | | |
|---|---|---|---|---|
| 5,246,339 | A * | 9/1993 | Bengtsson | F04D 29/544 415/208.1 |
| 6,139,265 | A * | 10/2000 | Alizadeh | F04D 29/544 415/208.1 |
| 6,244,818 | B1 * | 6/2001 | Chang | F04D 29/703 416/247 R |
| 7,118,333 | B2 * | 10/2006 | Takemoto | F04D 29/703 415/121.2 |
| 7,811,055 | B2 * | 10/2010 | Stommel | F04D 29/544 415/208.2 |
| 7,946,805 | B2 * | 5/2011 | Yoshida | F04D 19/007 415/220 |
| 8,025,490 | B2 * | 9/2011 | Lee | F04D 29/601 416/201 A |
| 10,485,136 | B2 * | 11/2019 | Gopalakrishna | G06F 1/181 |
| 10,731,881 | B2 * | 8/2020 | Amr | F24F 1/0029 |
| 10,760,593 | B2 * | 9/2020 | Strehle | F04D 29/703 |

(Continued)

*Primary Examiner* — Woody A Lee, Jr.
*Assistant Examiner* — Justin A Pruitt
(74) *Attorney, Agent, or Firm* — NIXON PEABODY LLP

(57) ABSTRACT

A fan guard for a fan container includes a housing and a plurality of wings. The housing has a hollow interior defined by a cylindrical inner surface. The housing extends longitudinally between a first housing end and a second housing end. The plurality of wings is positioned within the hollow interior of the housing. Each wing of the plurality of wings extends radially, from a center of symmetry of the cylindrical inner surface to the cylindrical inner surface. Each wing of the plurality of wings is radially curved between the first housing end and the second housing end.

18 Claims, 8 Drawing Sheets

(56) References Cited

U.S. PATENT DOCUMENTS

| | | | | |
|---|---|---|---|---|
| 11,019,748 | B2 * | 5/2021 | Avvaru | H05K 7/1489 |
| 11,661,955 | B2 * | 5/2023 | Huang | F04D 29/403 415/213.1 |

* cited by examiner

SERVER FAN GUARD

CROSS-REFERENCE TO RELATED APPLICATIONS

This application claims priority under 35 U.S.C. § 119 to U.S. Provisional Patent Application No. 63/013,363, filed on Apr. 21, 2020. The contents of that application are hereby incorporated by reference in their entirety.

TECHNICAL FIELD

This disclosure relates generally to fan guards, and more particularly, to fan guards for fans in server systems.

BACKGROUND

Fan guards, sometimes known as fan covers, are commonly used in server systems as physical barriers. For example, fan guards in server systems can be used to protect a technician from the moving parts of fans while performing maintenance. In some situations, when the technician conducts system debugging (e.g., hardware debugging), the server system may still be in operation, and the rotating blades of a fan may still be running. Thus, fan guards can provide protection from accidental contact with the rotating blades of cooling fans in the server system.

FIG. 1 shows a conventional example of a plate type fan guard 10. The plate type fan guard 10 is made of metal or plastic material, and includes hexagonal openings 12. The plate type fan guard 10 can be attached to a conventional fan system housing 20. FIG. 1 also shows another conventional example of a rod type fan guard 30 attached to another conventional fan system housing 40. The rod type fan guard 30 is flat and includes metal rods 32.

Typically, fan guards are either flat in shape, or are convex (i.e., curved away from the fan system housing when attached). The convex shape allows for additional safety distance between the technician and the rotating fan blades. However, fan systems having conventional fan guards generally must operate with higher fan power due to the additional pressure drop caused by the conventional fan guards. Thus, a need exists for a fan guard that can (i) aid in increased overall airflow of the fan system, and (ii) provide adequate protection for the user from the rotating fan blades. The present disclosure is directed to solving these problems.

SUMMARY

According to some implementations of the present disclosure, a fan guard for a fan container includes a housing and a plurality of wings. The housing has a hollow interior defined by a cylindrical inner surface. The housing extends longitudinally between a first housing end and a second housing end. The plurality of wings is positioned within the hollow interior of the housing. Each wing of the plurality of wings extends radially from a center of symmetry of the cylindrical inner surface to the cylindrical inner surface. Each wing of the plurality of wings is radially curved between the first housing end and the second housing end.

In some implementations, each wing of the plurality of wings is spaced at an equal distance from a neighboring wing of the plurality of wings.

In some implementations, the fan guard further includes a plurality of proximal air foil struts. Each strut of the plurality of proximal air foil struts connects two adjacent wings of the plurality of wings. The plurality of proximal air foil struts forms a polygon, which has a center positioned along the center of symmetry of the cylindrical inner surface. In some such implementations, the polygon is a circle.

In some implementations, the fan guard further includes another plurality of wings. Each of the another plurality of wings extends radially, from a corresponding one of the plurality of proximal air foil struts to the cylindrical inner surface. Each wing of the another plurality of wings is radially curved, between the first housing end and the second housing end.

In some implementations, a first curvature of the plurality of wings is the same as a second curvature of the another plurality of wings. In some such implementations, each wing of the another plurality of wings is spaced at an equal distance, from a neighboring wing of the another plurality of wings. In some such implementations, a first distance between each wing of the plurality of wings is the same as a second distance between each wing of the another plurality of wings. In some implementations, each wing of the another plurality of wings extends from a midpoint of a corresponding one of the plurality of proximal air foil struts.

In some implementations, the fan guard further includes a plurality of distal air foil struts. Each strut of the plurality of distal air foil struts connects two adjacent wings of the plurality of wings. The plurality of distal air foil struts forms another polygon, which has another center positioned along the center of symmetry of the cylindrical inner surface.

In some implementations, the housing includes a back plate mateable to outer edges of a first end of the fan container. The back plate forms a plane perpendicular to the center of symmetry of the cylindrical inner surface. In some such implementations, the fan container includes a cooling fan configured to generate an air flow from an opposing end of the fan container to the first end of the fan container. A distance between a corresponding point on each of the plurality of wings and the plane formed by the back plate is proportional to a speed of the air flow upstream from the corresponding point on each wing of first plurality of wings.

According to some implementations of the present disclosure, a fan system includes a fan container, a cooling fan, and a fan guard. The cooling fan is housed within the fan container, and has a plurality of rotatable blades. The plurality of rotatable blades forms a center of rotation and capable of causing an air flow. The fan guard is couplable to an end of the fan container and is downstream from the cooling fan. The fan guard includes a housing and a plurality of wings. The housing has a hollow interior defined by a cylindrical inner surface. The plurality of wings is positioned within the hollow interior of the housing. Each wing of the plurality of wings is radially curved between the first housing end and the second housing end.

In some implementations, the cooling fan is configured to generate an air flow from an opposing end of the fan container to the end of the fan container couplable to the fan guard. The distance between a corresponding point on each of the plurality of wings, and a plane formed by a back plate of the fan guard, is proportional to a speed of the air flow upstream from the corresponding point on each wing of first plurality of wings.

The above summary is not intended to represent each embodiment or every aspect of the present disclosure. Rather, the foregoing summary merely provides an example of some of the novel aspects and features set forth herein. The above features and advantages, and other features and advantages of the present disclosure, will be readily apparent from the following detailed description of representative embodiments and modes for carrying out the present invention, when taken in connection with the accompanying drawings and the appended claims.

BRIEF DESCRIPTION OF THE DRAWINGS

The foregoing and other advantages of the present disclosure will become apparent upon reading the following detailed description and upon reference to the drawings.

Figure 1:
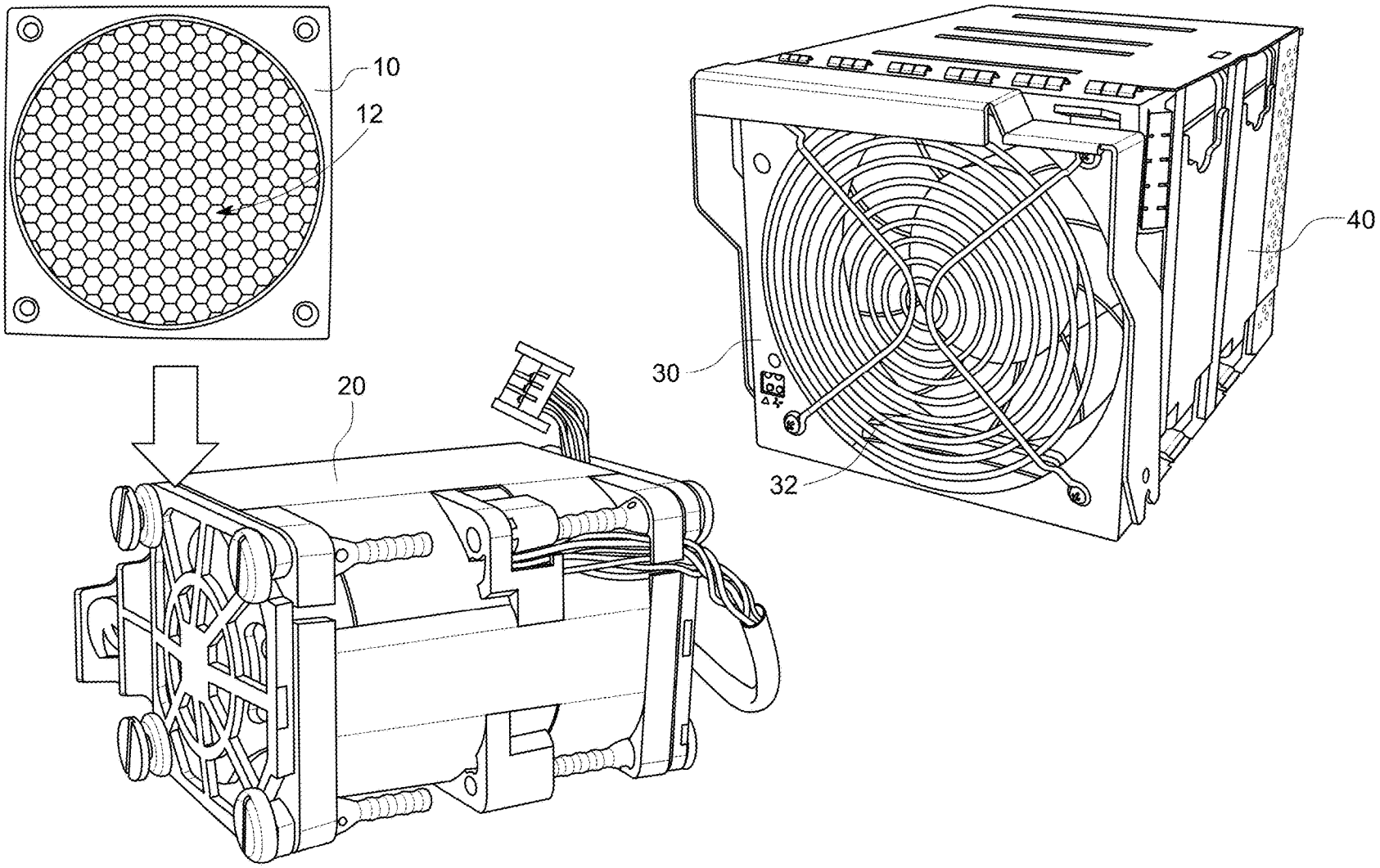
FIG. 1 (PRIOR ART)
FIG. 1 illustrates prior art fan guards for conventional fan systems.

While the present disclosure is susceptible to various modifications and alternative forms, specific implementations have been shown by way of example in the drawings and will be described in further detail herein. It should be understood, however, that the present disclosure is not intended to be limited to the particular forms disclosed. Rather, the present disclosure is to cover all modifications, equivalents, and alternatives falling within the spirit and scope of the present disclosure as defined by the appended claims.

DETAILED DESCRIPTION

The present disclosure is described with reference to the attached figures, where like reference numerals are used throughout the figures to designate similar or equivalent elements. The figures are not drawn to scale and are provided merely to illustrate the instant disclosure. Several aspects of the disclosure are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details, or with other methods. In other instances, well-known structures or operations are not shown in detail to avoid obscuring the invention. The present invention [various embodiments] is/are not limited by the illustrated ordering of acts or events, as some acts may occur in different orders and/or concurrently with other acts or events. Furthermore, not all illustrated acts or events are required to implement a methodology in accordance with the present invention.

The present disclosure relates to a fan guard having swept shaped wings positioned at a fan outlet of the fan system. The swept shape aids in minimizing the drawbacks of conventional fan guards. The swept shape can also help to increase the overall airflow in the fan system.

Figure 2:
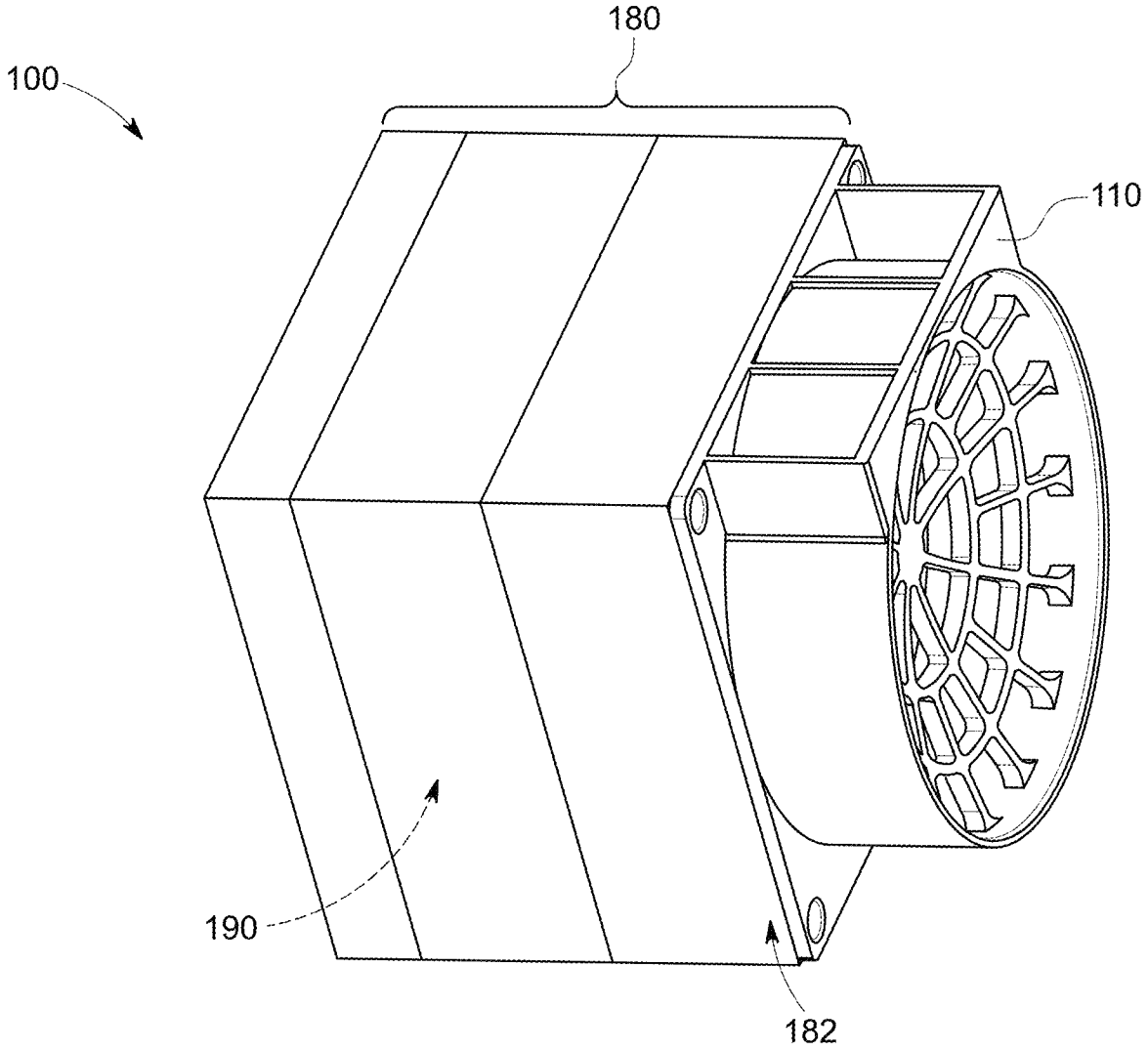
FIG. 2 is an axonometric view of a fan system, according to some implementations of the present disclosure.

Referring generally to FIG. 2, an axonometric view of a fan system 100 is illustrated, according to some implementations of the present disclosure. The fan system 100 includes a fan container 180, at least one cooling fan 190, and an example fan guard 110. In some implementations, the cooling fan 190 is housed within the fan container 180. In some implementations, the fan guard 110 is couplable to the proximal end 182 and/or surface of the fan container 180.

Figure 3:
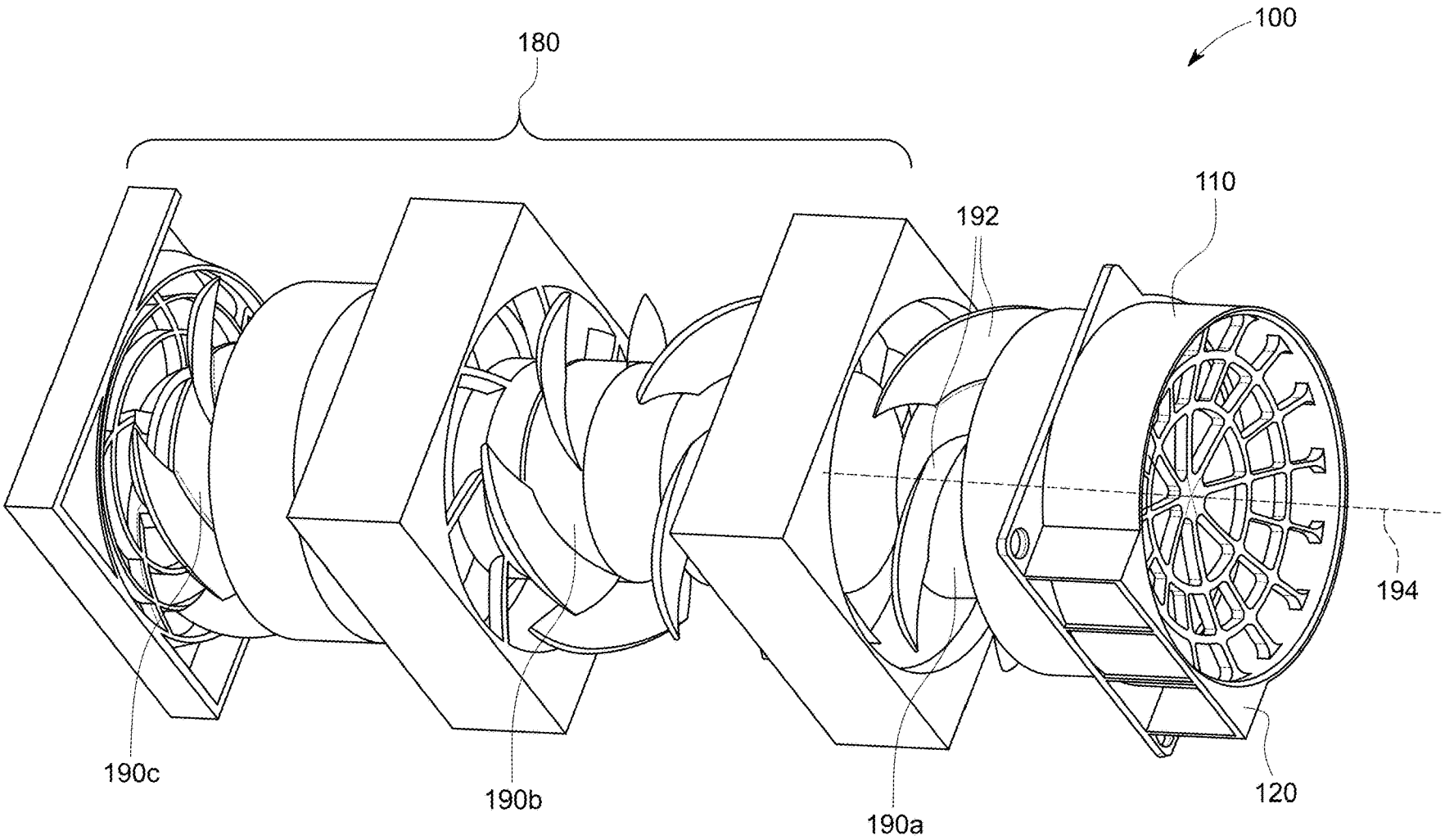
FIG. 3 is an exploded view of the fan system of FIG. 2, according to some implementations of the present disclosure.
Figure 4:
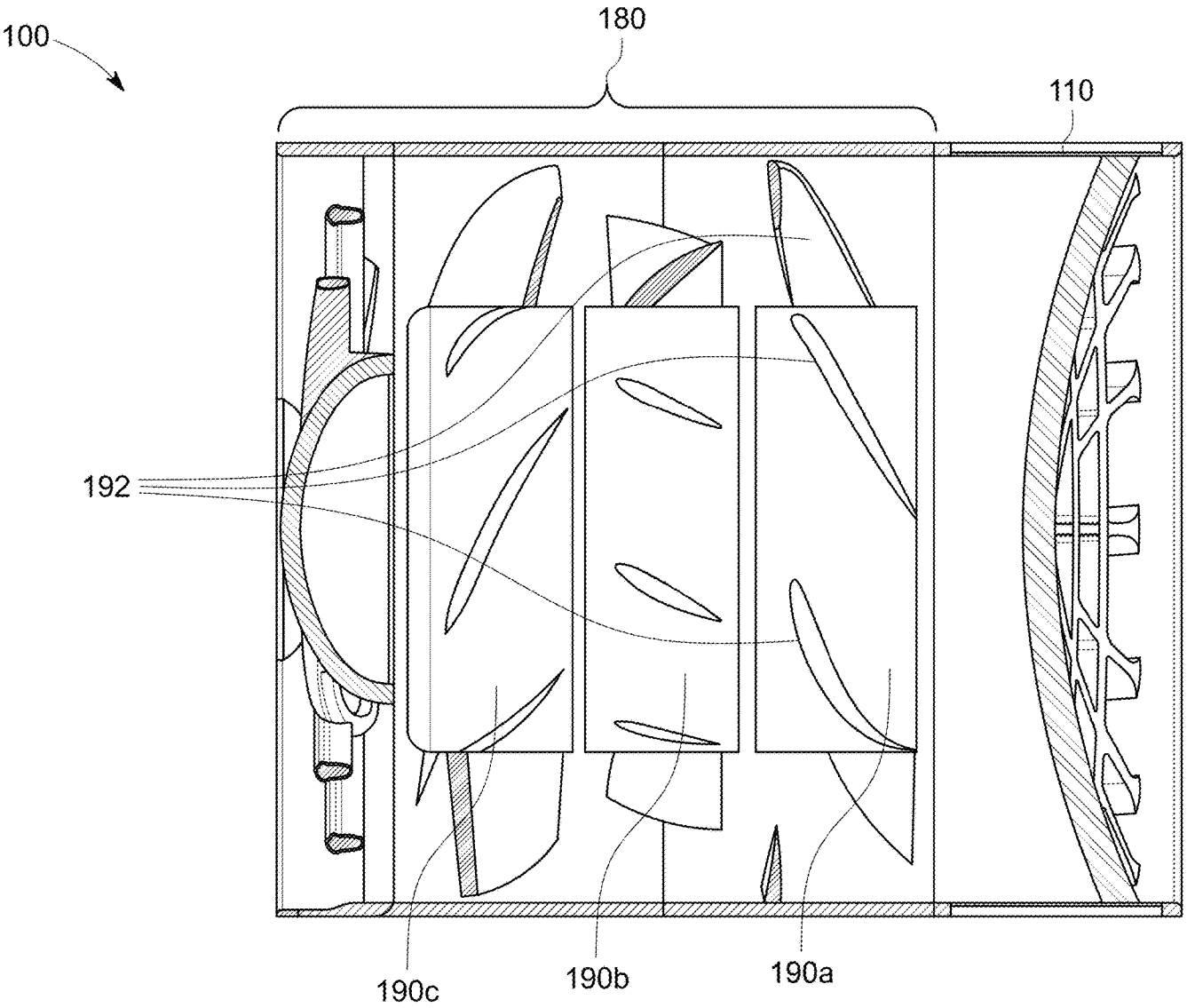
FIG. 4 is a side cross-sectional view of the fan system of FIG. 2, according to some implementations of the present disclosure.

FIG. 3 shows an exploded view of the fan system 100, and FIG. 4 shows a side cross-sectional view of the fan system 100, according to some implementations of the present disclosure. As shown, the fan system 100 includes three cooling fans 190*a*, 190*b*, and 190*c*. Each cooling fan 190*a*, 190*b*, and 190*c* has a number of rotatable blades. Alternatively, each cooling fan 190*a*, 190*b*, and 190*c* has a number of non-rotatable (e.g., static) blades. For example, the cooling fan 190*a* includes five rotatable blades 192, which define a center of rotation 194.

While the fan system 100 is shown in FIGS. 3-4 as having three cooling fans 190*a*, 190*b*, and 190*c*, the fan system of the present disclosure can have more or fewer cooling fans, such as one cooling fan, two cooling fans, five cooling fans, ten cooling fans, etc.

Figure 6:
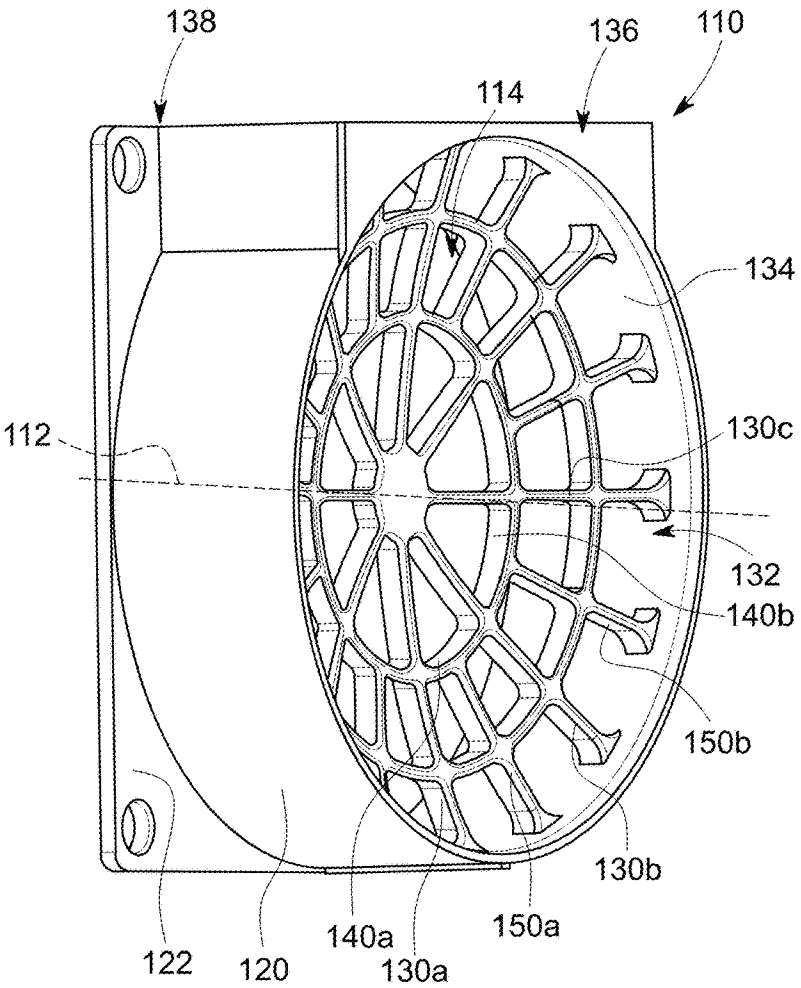
FIG. 6 is a side axonometric view of the example fan guard of FIG. 5, according to some implementations of the present disclosure.
Figure 5:
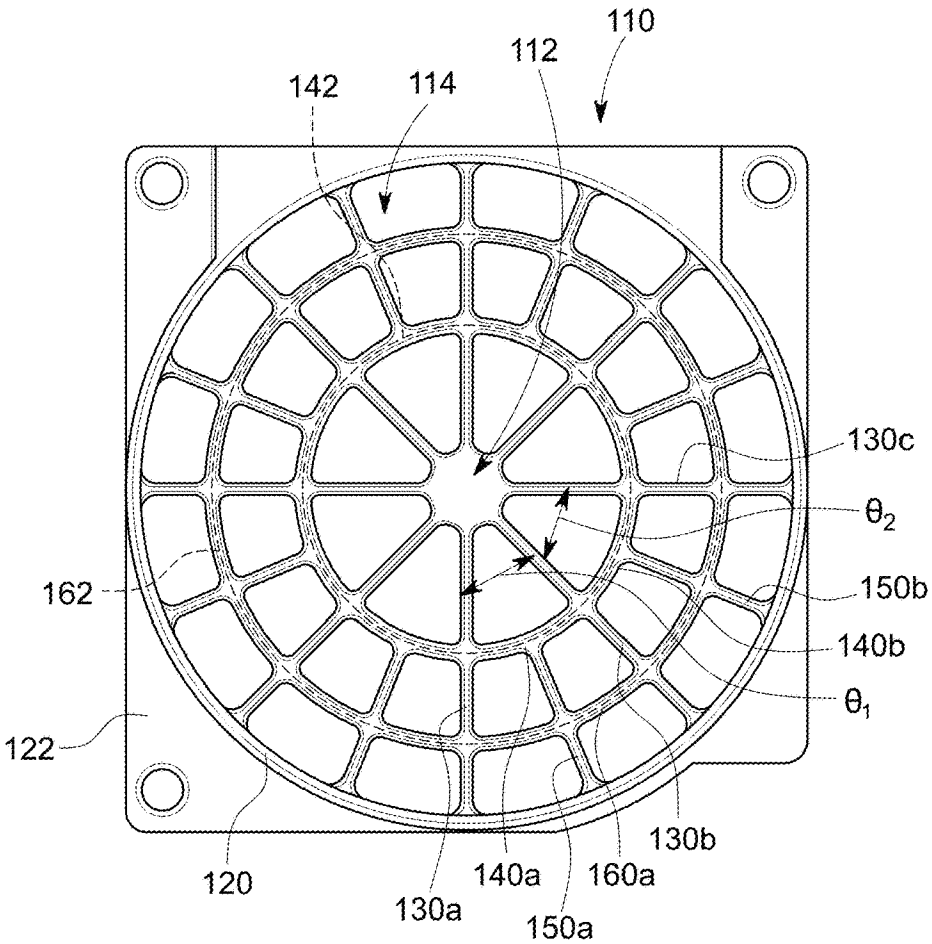
FIG. 5 is a front axonometric view of an example fan guard of the fan system of FIG. 2, according to some implementations of the present disclosure.

FIG. 5 is a front axonometric view of the example fan guard 110, and FIG. 6 shows a side axonometric view of the example fan guard 110, according to some implementations of the present disclosure. As shown, the fan guard 110 includes a housing 120. The housing 120 has a hollow interior 132, which in some implementations, is defined by a cylindrical inner surface 134. The housing 120 extends longitudinally between a first housing end 136 and a second housing end 138.

The fan guard 110 also includes eight long wings, such as a first long wing 130*a*, a second long wing 130*b*, and third long wing 130*c*. The long wings are positioned within the hollow interior 132 of the housing 120. Each long wing 130*a*, 130*b*, and 130*c* extends radially from a center of symmetry 112 of the cylindrical inner surface 134, to the cylindrical inner surface 134. In some implementations, the housing 120 of the fan guard 110 includes a back plate 122, which is mateable to outer edges of the proximal end 182 of the fan container 180 (FIG. 2). In some such implementations, the back plate 122 forms a plane perpendicular to the center of symmetry 112 of the cylindrical inner surface 134.

In some implementations, the fan guard 110 further includes proximal air foil struts, such as a first proximal strut 140*a*, and a second proximal strut 140*b*. Each of the proximal air foil struts connects two adjacent long wings. For example, the first proximal strut 140*a* connects the two adjacent long wings 130*a* and 130*b*; and the second proximal strut 140*b* connects the two adjacent long wings 130*b* and 130*c*. In some implementations, the plurality of proximal air foil struts forms a polygon 142, which has a center positioned along the center of symmetry 112 of the cylindrical inner surface 134. The polygon 142 may be of any geometric shape, such as a triangle, a rectangle, a pentagon, a hexagon, an octagon, a heptagon, a decagon, or a circle.

Still referring to FIGS. 5-6, in some implementations, the fan guard 110 further includes eight short wings, such as a first short wing 150*a*, and a second short wing 150*b*. Each short wing 150*a*, 150*b* extends radially from a corresponding one of proximal air foil struts to the cylindrical inner surface 134. For example, the short wing 150*a* extends from the proximal strut 140*a* to the cylindrical inner surface 134; and the short wing 150*b* extends from the proximal strut 140*b* to the cylindrical inner surface 134. In some such implementations, the short wing 150*a* extends from a midpoint of the proximal air foil strut 140*a*; and the short wing 150*b* extends from a midpoint of the proximal air foil strut 140*b*.

In some implementations, the fan guard 110 further includes distal air foil struts, such as the distal strut 160*a*. Each of the distal air foil struts connects two adjacent long wings. For example, the distal strut 160*a* connects the two adjacent long wings 130*a* and 130*b*. As shown in FIGS. 5-6, in some implementations, the distal strut 160*a* is connected to the short wing 150*a* at the midpoint of the distal strut 160*a* and/or the midpoint of the short wing 150*a*.

The distal air foil struts form another polygon 162, which has a center positioned along the center of symmetry 112 of the cylindrical inner surface 134. The polygon 162 can be any geometric shape, such as a triangle, a rectangle, a pentagon, a hexagon, an octagon, a heptagon, a decagon, or a circle.

As shown in FIG. 5, in some implementations, each long wing 130*a*, 130*b*, 130*c* of the long wings is spaced at an equal radial distance (e.g., the azimuth and/or the angle of separation) from a neighboring long wing. For example, the radial distance $\theta_1$ (between the long wing 130*a* and the long wing 130*b*) is the same as the radial distance $\theta_2$ (between the long wing 130*b* and the long wing 130*c*), which is about 30 degrees.

Additionally or alternatively, in some implementations, each short wing 150*a* and 150*b* of the short wings is spaced at an equal radial distance (e.g., the azimuth and/or the angle of separation) from a neighboring short wing. For example, the short wing 150*a* and the short wing 150*b* are spaced apart at the radial distance $\theta_3$. In some implementations, the radial distance $\theta_3$ between adjacent short wing 150*a* and 150*b* is the same as the radial distance $\theta_1$ or $\theta_2$ between adjacent long wings 130*a* and 130*b*, or 130*b* and 130*c*.

As shown in FIG. 6, in some implementations, each long wing 130*a*-130*c* is radially curved between the first housing end 136 and the second housing end 138. Additionally or alternatively, in some implementations, each short wing 150*a*, 150*b* is radially curved between the first housing end 136 and the second housing end 138. In some such implementations, a first curvature of the long wings 130*a*-130*c* is the same as a second curvature of the short wings 150*a*-150*b*.

As such, the long wings (e.g., 130*a*, 130*b*, 130*c*), the short wings (e.g., 150*a*, 150*b*), the proximal air foil struts (e.g., 140*a*, 140*b*), and the distal air foil struts (e.g., 160*a*, 160*b*) form a webbed surface 114, which is a concave shape. The webbed surface 114 also prevents the hands and/or fingers of a technician from contacting the fan guard 110, because even the largest opening on the webbed surface 114 has an area of 113 $mm^2$ or smaller, as shown in this example.

Figure 7:
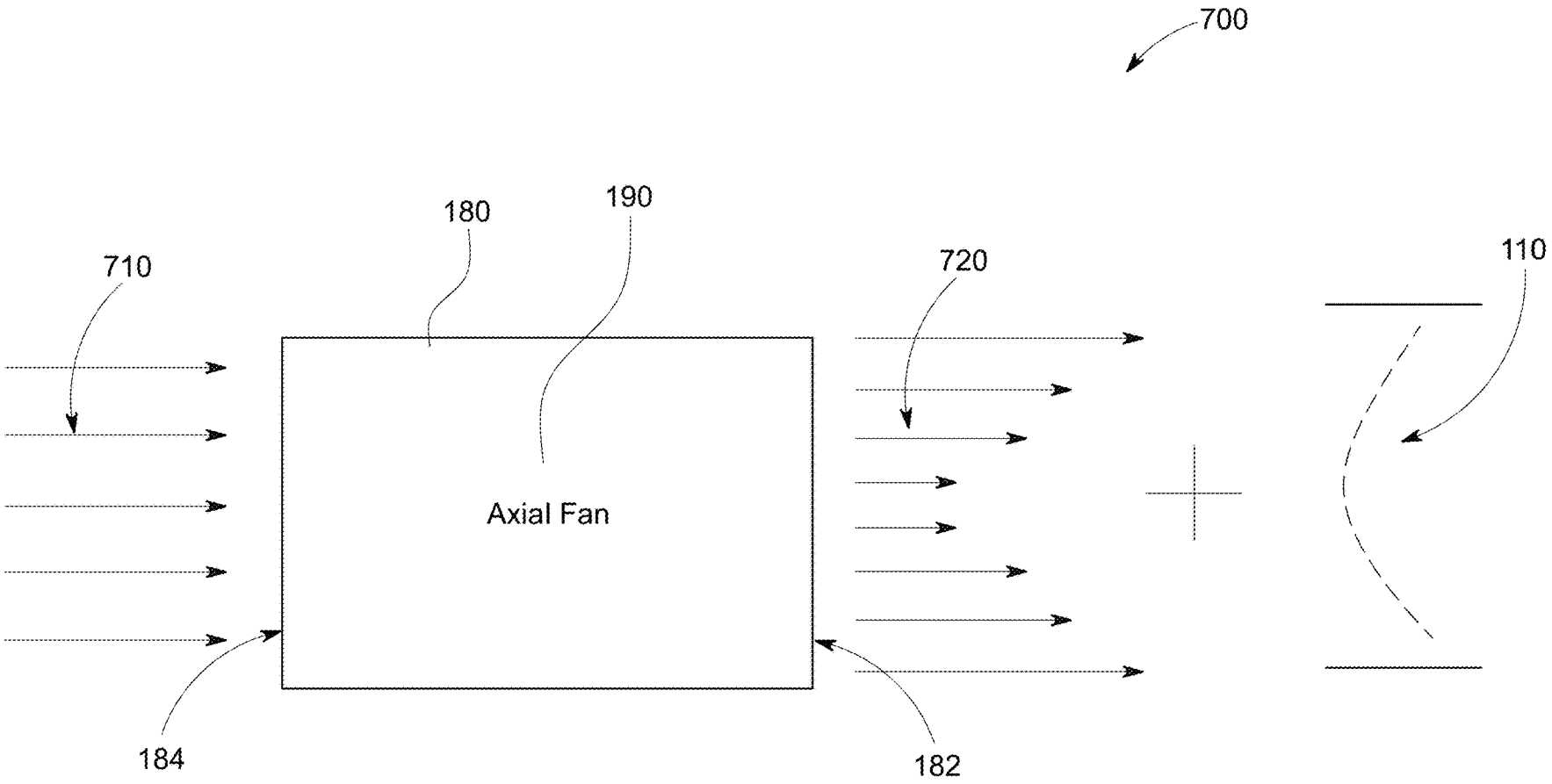
FIG. 7 illustrates changes in air flow in the fan system of FIG. 2, according to some implementations of the present disclosure.

FIG. 7 shows an air flow diagram 700 of the fan system 100 (FIG. 4), according to some implementations of the present disclosure. The cooling fan 190 is the same as, or similar to, one or more cooling fans 190*a*, 190*b*, and 190*c* shown in FIGS. 3-4. The rotatable blades (e.g., the rotatable blades 192 of the cooling fan 190*a* in FIGS. 3-4) of the cooling fan 190 are capable of generating an air flow when rotated by the motor of the cooling fan 190. As such, in some implementations, the cooling fan 190 is configured to generate and/or direct air flow from an opposing end 184 of the fan container 180, to the proximal end 182 of the fan container 180, and then to the fan guard 110.

In some implementations, due to the shape of the cooling fan 190 and/or the shapes of the rotatable blades, an entering air flow 710 to the cooling fan 190 can have a uniform velocity, while the exiting air flow 720 from the cooling fan 190 can have a varying velocity. For example, the air speed at the blade tips and/or edges is higher than the air speed at the center of the cooling fan 190. In some implementations, the fan guard 110 is positioned downstream from the cooling fan 190.

Thus, the concave webbed surface 114 (FIG. 6) of the fan guard 110 corresponds to the varying air speed of the exiting air flow 720 from the cooling fan 190. In some such implementations, the distance between a corresponding point on each of the long wings (e.g., 130*a*, 130*b*, 130*c* in FIG. 5) and the plane formed by the back plate 122 (FIGS. 5-6) is proportional to a speed of the air flow 720 upstream from the corresponding point on each of the long wings. Additionally or alternatively, in some such implementations, the distance between a corresponding point on each of the short wings (e.g., 150*a*, 150*b* in FIG. 5), and the plane formed by the back plate 122 (FIGS. 5-6) is proportional to a speed of the air flow 720 upstream from the corresponding point on each of the short wings.

Figure 8:
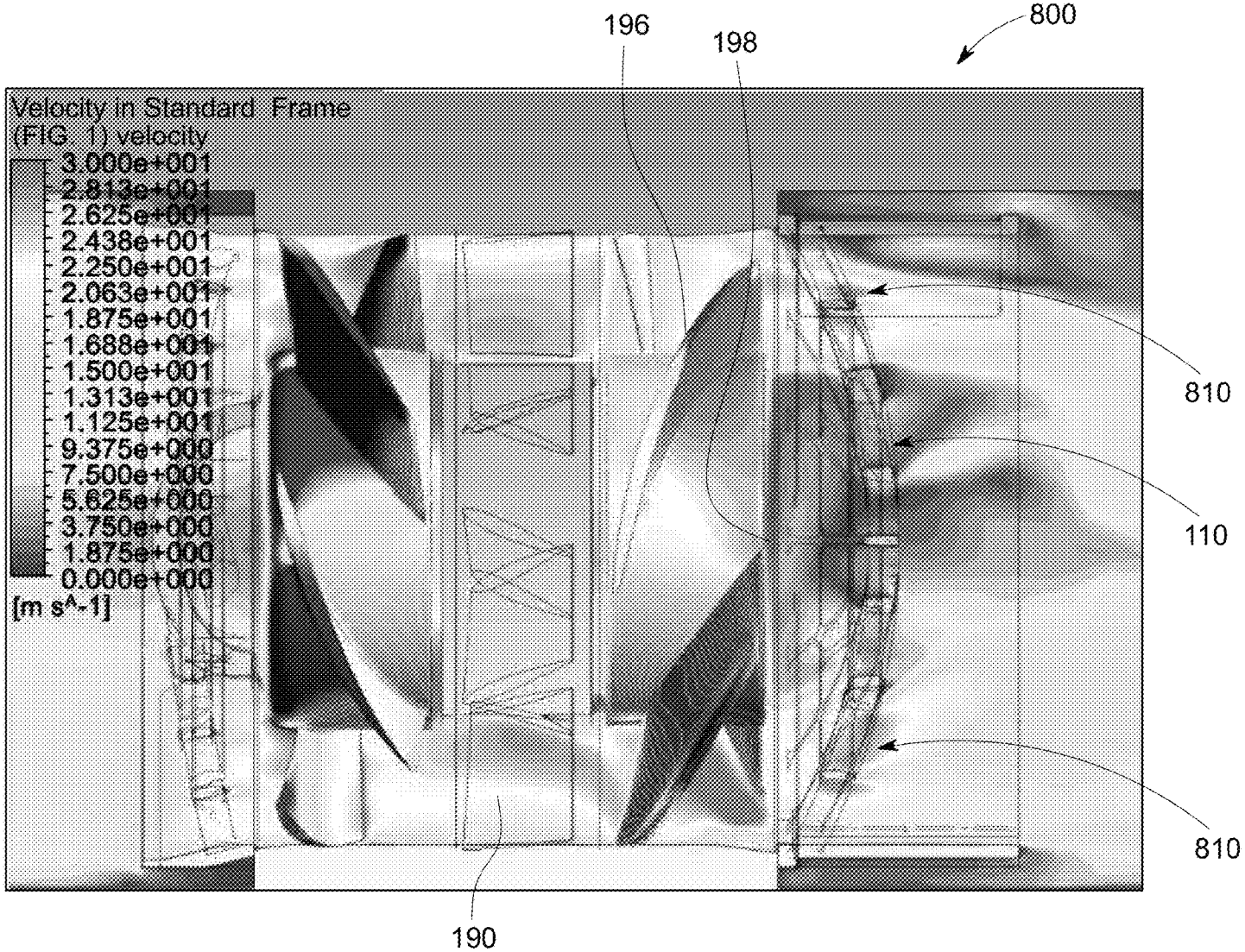
FIG. 8 illustrates a velocity map associated with a conventional fan system, according to some implementations of the present disclosure.
Figure 9:
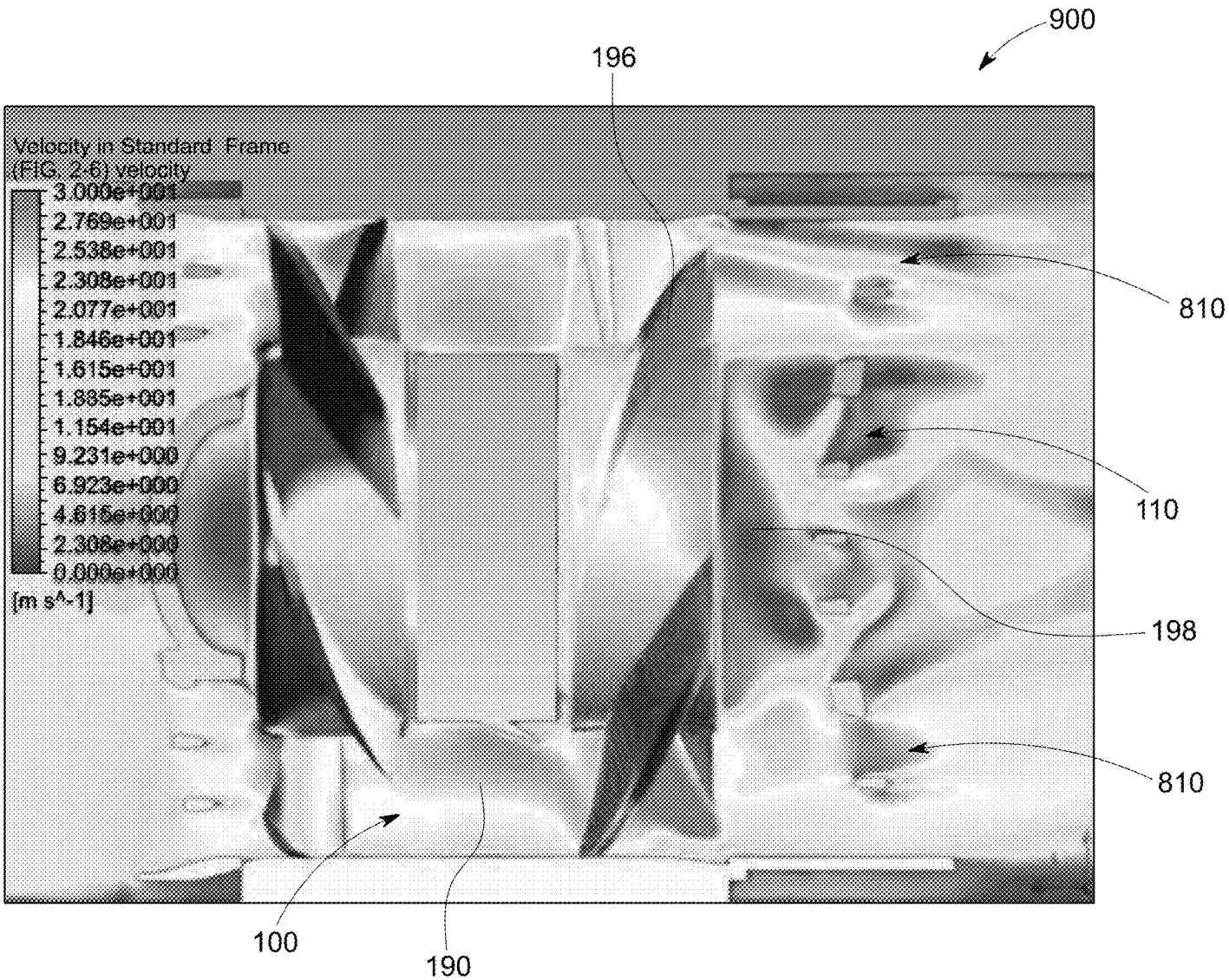
FIG. 9 illustrates a velocity map associated with the fan system of FIG. 2, according to some implementations of the present disclosure.

A comparison of FIGS. 8-9 shows the advantages of arranging the various components of the fan guard 110, as described herein. FIG. 8 illustrates a velocity map 800 (e.g., velocity contour) associated with a conventional convex fan system (e.g., the plate type fan guard 10 as shown in FIG. 1) using a computational fluid dynamics (CFD) simulation. The air speed at the blade tips and/or edges 196 is higher than the air speed at the center 198 of the cooling fan 190. Thus, the air flow is obstructed and/or distorted by the fan guard 10, because the fan guard 10 is closer to the blade tip and/or edges 196 than to the center 198 of the cooling fan 190.

FIG. 9 illustrates a velocity map 900 (e.g., velocity contour) associated with the present concave fan system 100 (FIGS. 2-6) using a CFD simulation. The air speed at the blade tips and/or edges 196 is higher than the air speed at the center 198 of the cooling fan 190. However, due to the convex shape of the fan guard 110, the fan guard 110 is farther from the blade tips and/or edges 196 than from the center 198 of the cooling fan 190, therefore causing less obstruction and/or distortion to the air flow.

Overall, the velocity map 900 shows more high speed air 910 (compared to high speed air 810 in FIG. 8) after the air flow passes the fan guard 110, compared to the velocity map 800. Thus, the overall air flow is higher using the fan guard 110, relative to use of the conventional fan guard 10 (FIG. 8). The higher air flow allows a fan with the fan guard 110 to consume less power, to generate the same air flow as a fan with a conventional fan guard.

One or more elements or aspects or steps, or any portion (s) thereof, from one or more of any of claims 1 and 13-19 below can be combined with one or more elements or aspects or steps, or any portion(s) thereof, from one or more of any of the other claims 1-11 and 13-19 or combinations thereof, to form one or more additional implementations and/or claims of the present disclosure.

While various embodiments of the present disclosure have been described above, it should be understood that they have been presented by way of example only, and not limitation. Numerous changes to the disclosed examples can be made in accordance with the disclosure herein without departing from the spirit or scope of the disclosure. Thus, the breadth and scope of the present disclosure should not be limited by any of the above described examples. Rather, the scope of the disclosure should be defined in accordance with the following claims and their equivalents.

Although the disclosed embodiments have been illustrated and described with respect to one or more implementations, equivalent alterations and modifications will occur to others skilled in the art upon the reading and understanding of this specification and the annexed drawings. In addition, while a particular feature of the disclosure may have been disclosed with respect to only one of several implementations, such feature may be combined with one or more other features of the other implementations as may be desired and advantageous for any given or particular application.

The terminology used herein is for the purpose of describing particular examples only and is not intended to be limiting of the disclosure. As used herein, the singular forms "a," "an," and "the" are intended to include the plural forms as well, unless the context clearly indicates otherwise. Furthermore, to the extent that the terms "including," "includes," "having," "has," "with," or variants thereof, are used in either the detailed description and/or the claims, such terms are intended to be inclusive in a manner similar to the term "comprising."

Unless otherwise defined, all terms (including technical and scientific terms) used herein have the same meaning as commonly understood by one of ordinary skill in the art to which this disclosure belongs. Furthermore, terms, such as those defined in commonly used dictionaries, should be interpreted as having a meaning that is consistent with their meaning in the context of the relevant art, and will not be interpreted in an idealized or overly formal sense unless expressly so defined herein.

What is claimed is:

1. A server system comprising:

a fan container having an exterior surface;

a plurality of cooling fans positioned within the fan container, the plurality of cooling fans including a first fan and a second fan, the first fan being positioned adjacent to the second fan, the first fan creating an air flow towards the second fan, the second fan continuing the air flow towards the exterior surface of the fan container; and a fan guard coupled directly to and extending from the exterior surface of the fan container, the fan guard being outside the fan container and adjacent to the second fan, the fan guard receiving the air flow in an area outside the fan container, the fan guard including a housing having a hollow interior defined by a cylindrical inner surface, the cylindrical inner surface defining a full cylindrical shape for the hollow interior, the housing extending longitudinally between a first housing end and a second housing end, the first housing end being adjacent to the exterior surface of the fan container, the second housing end being outside and away from the exterior surface of the fan container, the housing being configured to receive the air flow from the plurality of cooling fans, the air flow entering at the first housing end and exiting at the second housing end, the housing further having an outer surface that includes a cylindrical portion and a non-cylindrical portion, the non-cylindrical portion including two opposing straight edges extending from respective intersections with the cylindrical portion, the two opposing straight edges being connected by an intermediate straight edge that is generally perpendicular to each of the two opposing straight edges; and a plurality of wings positioned within the hollow interior of the housing, each wing of the plurality of wings extending radially from a center of symmetry of the cylindrical inner surface to the cylindrical inner surface, each wing of the plurality of wings having a radial curvature between the first housing end and the second housing end, the radial curvature forming a concave shape that extends longitudinally between the first housing end, where the air flow enters, and the second housing end, where the air flow exits, the concave shape of each wing being (a) closer to the first housing end at the center of symmetry and (b) closer to the second housing end at a point of contact with the cylindrical inner surface.

2. The server system of claim 1, wherein each wing of the plurality of wings is spaced at an equal distance from a neighboring wing of the plurality of wings.

3. The server system of claim 1, further comprising a plurality of proximal air foil struts, each strut of the plurality of proximal air foil struts connecting two adjacent wings of the plurality of wings, the plurality of proximal air foil struts forming a polygon having a center positioned along the center of symmetry of the cylindrical inner surface.

4. The server system of claim 3, wherein the polygon is a circle.

5. The server system of claim 3, further comprising another plurality of wings, each wing of the another plurality of wings extending radially from a corresponding one of the plurality of proximal air foil struts to the cylindrical inner surface, each wing of the another plurality of wings being radially curved between the first housing end and the second housing end.

6. The server system of claim 5, wherein a first curvature of the plurality of wings is the same as a second curvature of the another plurality of wings.

7. The server system of claim 5, wherein each wing of the another plurality of wings is spaced at an equal distance from a neighboring wing of the another plurality of wings.

8. The server system of claim 7, wherein a first distance between each wing of the plurality of wings is the same as a second distance between each wing of the another plurality of wings.

9. The server system of claim 5, wherein each wing of the another plurality of wings extends from a midpoint of a corresponding one of the plurality of proximal air foil struts.

10. The server system of claim 3, further comprising a plurality of distal air foil struts, each strut of the plurality of distal air foil struts connecting two adjacent wings of the plurality of wings, the plurality of distal air foil struts forming another polygon having another center positioned along the center of symmetry of the cylindrical inner surface.

11. The server system of claim 1, wherein the housing includes a back plate mateable to outer edges of a first end of the fan container, the back plate forming a plane perpendicular to the center of symmetry of the cylindrical inner surface.

12. A server system, comprising:

a fan container having an exterior surface;

a plurality of cooling fans housed within the fan container, each fan of the plurality of cooling fans having a plurality of rotatable blades, the plurality of rotatable blades forming a center of rotation and capable of causing an air flow, the plurality of cooling fans including a first fan and a second fan, the first fan being positioned adjacent to the second fan, the first fan moving the air flow towards the second fan, the second fan continuing the air flow towards the exterior surface of the fan container; and a fan guard coupled directly to and extending from the exterior surface of the fan container, the fan guard being outside the fan container and adjacent to the second fan, the fan guard receiving the air flow in an area outside the fan container, the fan guard being downstream from the plurality of cooling fans, the fan guard including:

a housing having a hollow interior defined by a cylindrical inner surface, the housing extending longitudinally between a first housing end and a second housing end, the first housing end being adjacent to the exterior surface of the fan container, the second housing end being outside and away from the exterior surface of the fan container, the air flow entering at the first housing end and exiting at the second housing end, the housing further having an outer surface that includes a cylindrical portion and a non-cylindrical portion, the non-cylindrical portion including two opposing straight edges extending from respective intersections with the cylindrical portion, the two opposing straight edges being connected by an intermediate straight edge; and a plurality of wings positioned within the hollow interior of the housing, each wing of the plurality of wings being radially curved between the first housing end and the second housing end, each wing being radially curved into a concave shape that extends longitudinally between the first housing end, where the air flow enters, and the second housing end, where the air flow exits, the concave shape of each wing being (a) closer to the first housing end at the center of symmetry and (b) closer to the second housing end at a point of contact with the cylindrical inner surface.

13. The server system of claim 12, wherein each wing of the plurality of wings extends radially from a center of symmetry of the cylindrical inner surface to the cylindrical inner surface.

14. The server system of claim 12, wherein the fan guard further includes a plurality of proximal air foil struts, each strut of the plurality of proximal air foil struts connecting two adjacent wings of the plurality of wings, the plurality of proximal air foil struts forming a polygon having a center positioned along the center of symmetry of the cylindrical inner surface.

15. The server system of claim 14, wherein the fan guard further includes another plurality of wings, each wing of the another plurality of wings extending radially from a corresponding one of the plurality of proximal air foil struts to the cylindrical inner surface, each wing of the another plurality of wings being radially curved between the first housing end and the second housing end.

16. The server system of claim 15, wherein a first curvature of the plurality of wings is the same as a second curvature of the another plurality of wings.

17. The server system of claim 15, wherein each wing of the another plurality of wings is spaced at an equal distance from a neighboring wing of the another plurality of wings; and wherein a first distance between each wing of the plurality of wings is the same as a second distance between each wing of the another plurality of wings.

18. The server system of claim 12, wherein the fan guard further includes a plurality of distal air foil struts, each strut of the plurality of distal air foil struts connecting two adjacent wings of the plurality of wings, the plurality of distal air foil struts forming another polygon having another center positioned along the center of symmetry of the cylindrical inner surface.

* * * * *